United States Patent [19]

Langdon

[11] Patent Number: 4,748,905

[45] Date of Patent: Jun. 7, 1988

[54] APPARATUS FOR AND METHOD OF COMPACTING AND DEWATERING REFUSE

[76] Inventor: John O. Langdon, 13814 Britoak, Houston, Tex. 77079

[21] Appl. No.: 491,285

[22] Filed: May 3, 1983

[51] Int. Cl.[4] ..... B30B 9/30

[52] U.S. Cl. ..... 100/90; 100/107; 100/37; 53/107

[58] Field of Search ..... 100/90, 107, 108, 109, 100/269 R, 215, 37; 53/103–107, 434, 509, 512, 527, 556; 55/189; 220/255, 1 T; 49/94, 104, 114

[56] References Cited

U.S. PATENT DOCUMENTS

| | | | |
|---|---|---|---|
| 2,640,342 | 6/1953 | Rand | 100/37 |
| 3,254,467 | 6/1966 | Garrow et al. | 100/90 X |
| 3,394,832 | 7/1968 | McAllister et al. | 220/1 T |
| 3,458,966 | 8/1969 | Dunbar et al. | 53/434 X |
| 3,511,020 | 5/1970 | Kraft et al. | 53/512 |
| 4,183,295 | 1/1980 | Peterson | 100/233 X |
| 4,324,088 | 4/1982 | Yamashita et al. | 53/527 |

*Primary Examiner*—Harvey C. Hornsby
*Assistant Examiner*—Frankie L. Stinson
*Attorney, Agent, or Firm*—Vaden, Eickenroht, Thompson & Boulware

[57] ABSTRACT

A refuse compactor is disclosed that includes a flexible bag of non-permeable material having an opening through which refuse can be placed in the bag. The bag is supported in an upright position to receive refuse through the openings in the bag. A lid is positioned to close the opening in the bag, as the pressure in the bag is reduced below atmospheric pressure periodically to crush and compact the refuse in the bag. The pressure is reduced by pumping air from the bag through a flexible hose that extends to the bottom of the bag to that any liquid collected in the bottom of the bag will be moved also.

14 Claims, 3 Drawing Sheets

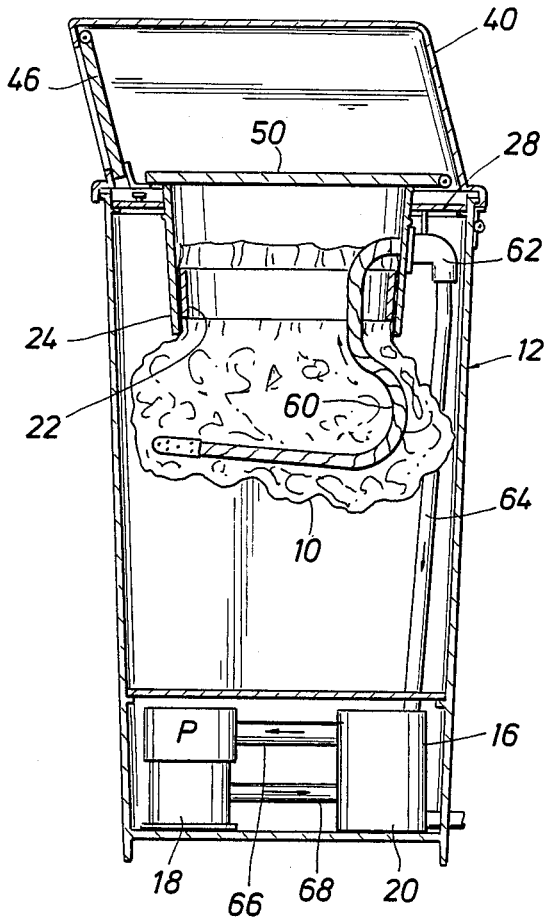
FIG. 4
FIG. 6
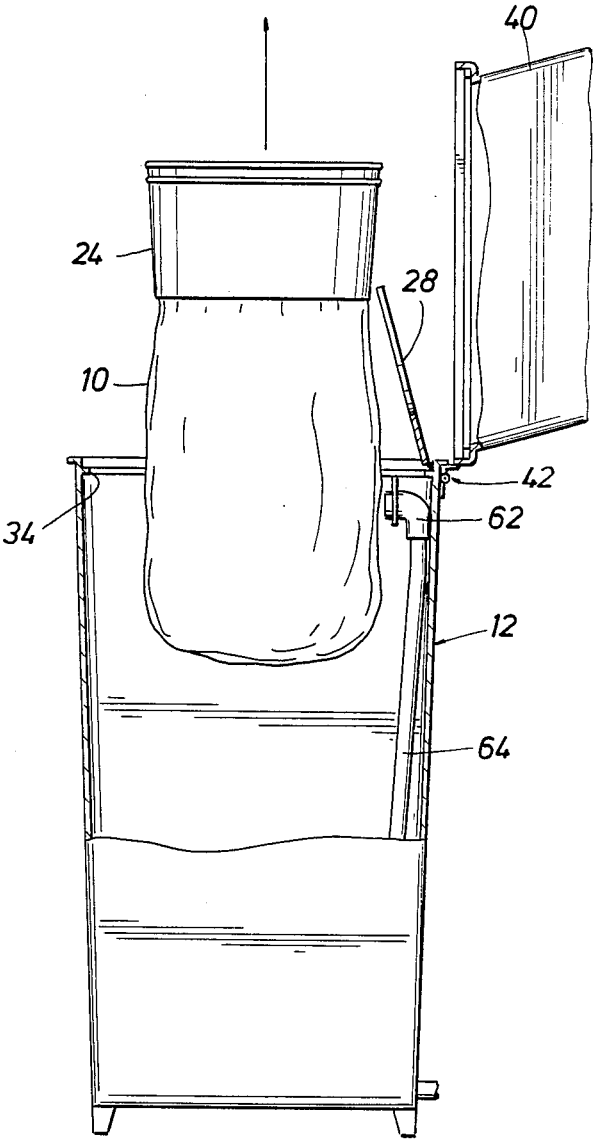
FIG. 5
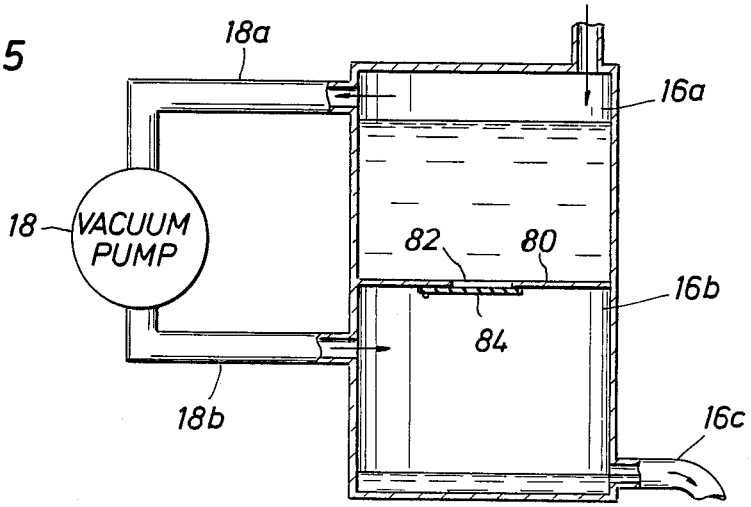

APPARATUS FOR AND METHOD OF COMPACTING AND DEWATERING REFUSE

This invention relates to apparatus for and a method of compacting refuse generally and, in particular, to a compactor that employs the differential pressure between a vacuum and atmospheric pressure to provide the force to compact the refuse.

This invention has utility for compacting most any type of refuse, but it is particularly useful for compacting and also dewatering refuse consisting of paper cups with ice and soft drinks left in them, paper plates, and plastic containers that makes up substantially all the refuse generated by a fast food restaurant. This refuse is collected in trash cans inside the restaurant and periodically dumped in large trash bins located adjacent the restaurant, usually on a back corner of the parking lot. The trash bins are emptied periodically, usually once a day.

These trash bins are eyesores. Further, the ice in the cups melts and mixes with the soft drinks left in the cups to form a sugary, sticky liquid that leaks out of the trash bins onto the parking lots. Light weight paper items, such as napkins, are blown out of the trash bins when the doors are opened littering the adjacent area. The discarded food and syrupy liquids attract flies and roaches. Obviously, this arrangement for handing refuse is unsatisfactory.

Therefore, it is an object of this invention to provide apparatus for and a method of compacting refuse in which a disposible, flexible wall bag of impermeable material receives the refuse and collapses on the refuse when the air pressure in the bag is reduced to compact the refuse using the differential pressure across the bag.

It is another object of this invention to provide an improved refuse compactor and refuse dewaterer in which the refuse is compacted in the container in which it is first placed and from which the liquid, such as melted ice, soft drinks, and the like, is removed as the refuse is being compacted.

It is a further object of this invention to provide a refuse compactor in which the refuse is compacted in the container in which it is first placed, which container can be closed when full to contain the compacted refuse in the container and moved to its final disposal location still in the original container.

It is a further object of this invention to provide a refuse compactor that includes a non-permeable, flexible wall, disposable bag in which the refuse is originally placed after which the atmospheric pressure in the bag is reduced to cause the ambient atmospheric pressure to crush and compact the refuse in the bag periodically as the bag is filled with refuse after which the bag is removed and its open end closed so that the bag with the refuse therein can be conveyed to an incinerator, landfill, or the like without ever being removed from the original container in which it was placed.

These and other objects, advantages, and features of this invention will be apparent to those skilled in the art from a consideration of this specification including the attached drawings and appended claims.

In the drawings:

FIG. 4 is a view of the compactor of FIG. 1 as it is compacting refuse;

FIG. 5 is a view similar to FIG. 3 showing the vacuum pump and air and liquid separator in operation as air is being removed from the flexible bag of the compactor during a compacting operation;

FIG. 6 is a view of the compactor of FIG. 1 and FIG. 4 as the full bag of compacted refuse in removed for storage or movement to its final place of disposal, such as a landfill, incinerator, or the like.

Figure 1:
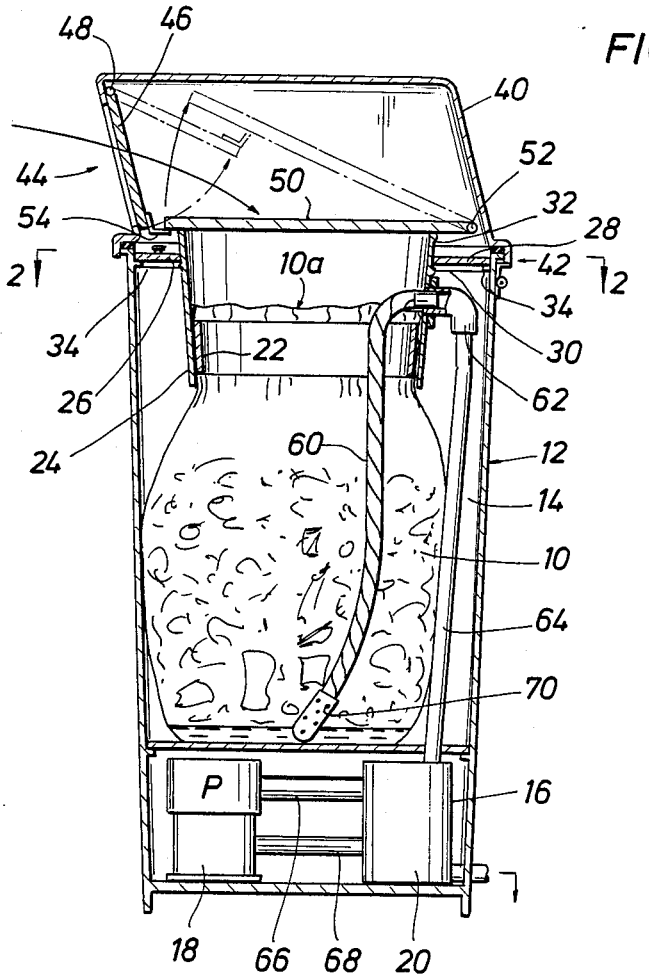
FIG. 1 is a vertical sectional view through the preferred embodiment of the refuse compactor and dewaterer of this invention.

The apparatus of this invention includes flexible wall bag 10 made of non-permeable material, as for example, one of the plastic trash bags that are made and sold by many different manufacturers and in many different sizes.

Means are provided for supporting bag 10 in an upright position with the opening in the bag facing upwardly to receive refuse into the bag through the opening. In the embodiment shown, such means include rectangular cabinet 12 having upper compartment 14 in which bag 10 is located and lower compartment 16 in which vacuum pump 18 and liquid air separator 20 are located. Opening **10*a* in bag 10 is held in the open position and suspended above bottom 14*a* of compartment 14 of the housing by annular members 22 and 24. Both members have tapered sides that are inclined at the same angle. Annular member 22 is much shorter than outer annular member 24 and has a diameter such that it can pass through the opening in the upper end of member 24 but cannot pass out the bottom end. Inner annular member 22 can be pushed downwardly in outer annular member 24 to clamp the side wall of bag 10 between the two members adjacent the open end of the bag. These members not only hold the bag open to receive refuse, but also suspend it above the bottom of the compartment 14** so it can be filled with refuse. Preferably, the lower end of the bag rests on the bottom of the compartment to help support the weight of the refuse as the bag fills.

The annular members when so nested also form a pneumatic seal with the bag such and air outside the bag cannot pass between the two annular members and enter the bag when the pressure in the bag is reduced in the manner to be described below.

Figure 2:
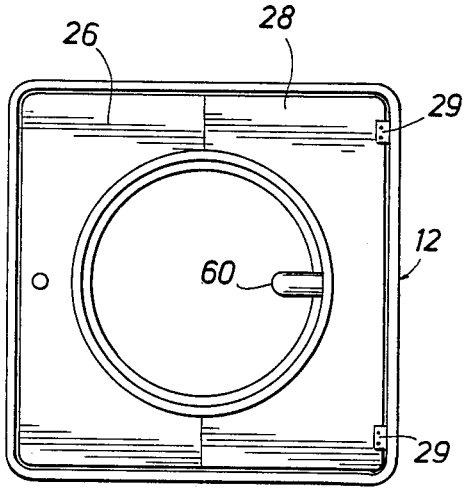
FIG. 2 is a section taken along line 2—2 of FIG. 1.

The annular members are supported in the upper end of compartment 14 of cabinet 12 by supporting plates 26 and 28. Each plate extends halfway across the opening in the top of the cabinet and each plate is provided with a semicircular cavity to engage annular member 24 between annular rings 30 and 32 adjacent the upper end of the annular member. The cavities in the mounting plates are of such a diameter that when positioned as shown in FIG. 1 and FIG. 2, annular member 24 will be supported on the mounting plates by annular rib 32 adjacent the upper end of the outer annular member. Mounting plate 28 is attached to the upper end of the cabinet by hinges 29 for pivotal movement upwardly whereas mounting plate is completely removable. Both plates are supported on their outer edges by flange 34 that extends around the upper opening in the cabinet.

Hood or cover 40 is attached to the upper end of cabinet 12 by hinges 42 on the right hand side, as viewed in FIG. 1. The other sides of cover 40 simply rest on the upper edges of cabinet 12 when the cover is positioned as shown in FIG. 1. Opening 44 is located in the side of the cover opposite the hinged side. It is normally closed by door 46 that is mounted on the inside of cover 40 for pivotal movement by rod 48 that extends across the upper end of the cover and is supported by opposite sides of the cover. Door 46 may be spring loaded to urge it into position to close opening 44 or gravity may be used to urge it to the position shown in FIG. 1.

Means are also provided to close opening 10*a* in bag 10 to allow the pressure in the bag to be reduced below atmospheric so that the pressure differential between the pressure in the bag and the ambient atmosheric pressure will compact the refuse in the bag. In the embodiment shown, such means include lid 50. It is mounted on pivot rod 52, which is supported by cover 40, to engage the upper end of annular member 24 and prevent air from passing through the annular members into the bag when the pressure in the bag is reduced in the manner to be described below. Lit 50 being pivotally mounted on rod 52 is moved upwardly away from annular member 24 to the position, shown in dotted lines when door 46 is opened from the outside to allow refuse to be deposited through opening 44 into bag 10. When door 46 returns to its normal position, as shown in FIG. 1, lid 50 will return to its position extending across the upper end of annular member 24. In order for door 46 to move lid 50 when the door is opened, resilient finger 54 is attached to the lower end of door 46 and extends under the portion of lid 50 that extends beyond annular member 24. As door 46 is pivoted upwardly, the finger will carry lid 50 with it to the position shown in dotted lines in FIG. 1.

The lower surface of lid 50 that engages the upper end of annular member 24 is provided with a sealing material that will form a seal between the lid and the annular member when the lid is down. Alternatively, the sealing material could be placed on the upper end of the annular member.

In accordance with the method of this invention, after the steps have been taken to support a flexible wall non-permeable bag in a vertical position with the opening of the bag facing upwardly and placing refuse in the bag, the open end of the bag is closed and the pressure in the bag is reduced to cause the pressure differential between that in the bag and ambient atmospheric pressure to collapse the walls of the bag onto the refuse and compact it. In the embodiment shown, the means for reducing the pressure in the bag include flexible hose 60, which is located in bag 10 with one end extending to a point adjacent the bottom of the bag and the other end connected to elbow 62 that extends through an opening provided in annular member 24. Conduit 64 connects elbow 62 to the upper end of liquid and air separator 16 which is in turn connected to vacuum pump 18 by conduits 66 and 68. Flexible disc 63 attached to elbow 62 is moved into sealing engagement with annular member 24 as the pressure in the bag is released to seal the opening through which the elbow extends.

Since, in most cases, it will be desired to remove the water and other liquid from the refuse during the compacting operation, hose 60 is provided with openings 70 at the lower end adjacent the bottom of the bag. If this is not desirable or necessary, then the hose can be much shorter and it can be provided with perforations along its entire length. The hose is flexible because, as the bag is collapsed onto the refuse and the hose, it is hard to predict what configuration the bag will take due to the refuse in the bag and the hose has to be able to adapt acordingly. An example of one position the bag and hose may take is shown in FIG. 4.

To compact the refuse, vacuum pump 18 lowers the pressure in bag 10 with lid 50 closing the open end causing atmospheric pressure outside the bag to collapse the bag around the refuse in the bag and exert a compacting force on the refuse in the bag, the amount of which is determined by the amount of differential pressure. It is contemplated that the compacting operation will occur periodically as the bag is being filled. It could occur at timed intervals or it could be initiated by an operator who, from time to time, checks to see if the refuse needs to be compacted. Alternatively, it could be arranged to compact refuse after door 46 has been opened a predetermined number of times.

After the bag is full or contains the weight of the refuse that the bag is designed to handle, the bag is removed and replaced by an empty one. To remove the bag, as shown in FIG. 6, cover 40 is rotated out of the way on hinges 42. If door 46 is gravity operated, it will move to the position shown in FIG. 6 and hold lid 50 out of the way inside cover 40. Mounting plate 26 is then removed and the bag can be pulled upwardly out of cabinet 12 by annular members 22 and 24. After which the annular members are removed and the top of the bag is closed and tied. A new bag is clamped between the annular members and placed in position inside cabinet 12 where the annular members will again be suppored by mounting plates 26 and 28.

Figure 3:
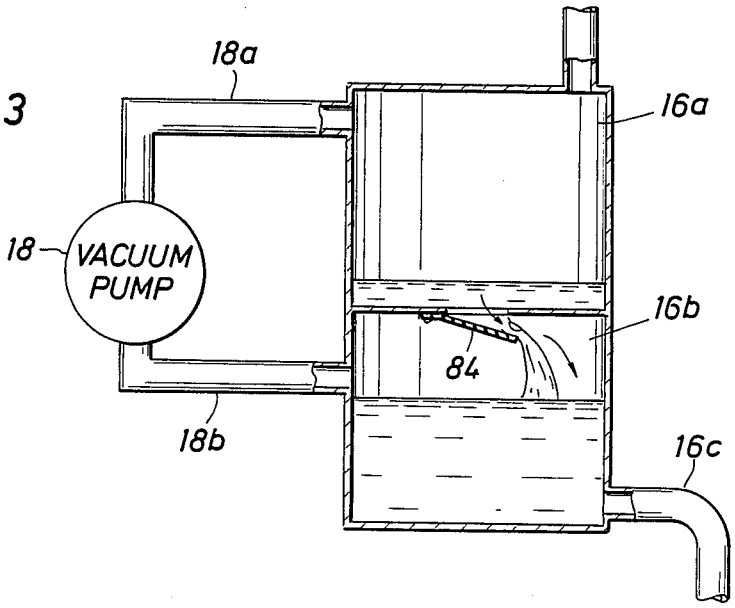
FIG. 3 is a view, partly in section and partly in elevation, of the liquid and air separator used to separate the liquid and air removed from the refuse compactor when the vacuum pump is not operating.

The operation of liquid and air separator 20 is shown in FIGS. 3 and 5. In FIG. 3, vacuum pump 18 is not operating. In FIG. 5, the vacuum pump is operating and a compacting operation is taking place. Air and liquid is drawn out of the bag through hose 60, elbow 62, and conduit 64 into upper compartment 16*a* of separator 16. There the air in the air-liquid mixture must travel laterally to inlet 18*a* of the vacuum pump. As it moves laterally, the liquid from the bag will drop out of the flowing stream to the bottom of compartment 16 of the separator. The air drawn out of the bag by the vacuum pump is then discharged into lower compartment 16*b*. The air can leave the lower compartment through outlet 16*c*.

Dividing separator 16 into upper and lower compartments 16*a* and 16*b* is partition 80. The partition is provided with opening 82 that connects the two compartments. Flexible flapper valve 84 is attached to the lower side of partition 80. During the compacting operation, the pressure in compartment 16*a* will be less than the pressure in compartment 16*b* even with the weight of the separated liquid acting on the valve. This differential pressure will hold flapper valve 84 in the position, shown in FIG. 5, extending across and closing opening 82. This will cause the water being removed from the bag to be retained in upper compartment 16*a*, and in fact, provide a water seal between the air entering inlet 18*a* of the vacuum pump and being discharged through outlet 18*b*.

As soon as the compacting operation is finished, vacuum pump 18 will stop pumping, the pressure in the two compartments will equalize and flapper valve 84 will be moved downwardly by the weight of the water in the upper compartment allowing the water to drain into the lower compartment and out through outlet 16*c* into a drain or container as desired.

The liquid and air separator is not needed where the apparatus and method of this invention is being used to compact leaves for example or any other refuse not containing a significant amount of liquid, but it is very helpful in situations such as those described above wherein the refuse will contain ice and unfinished soft drinks and the like.

Figure 7:
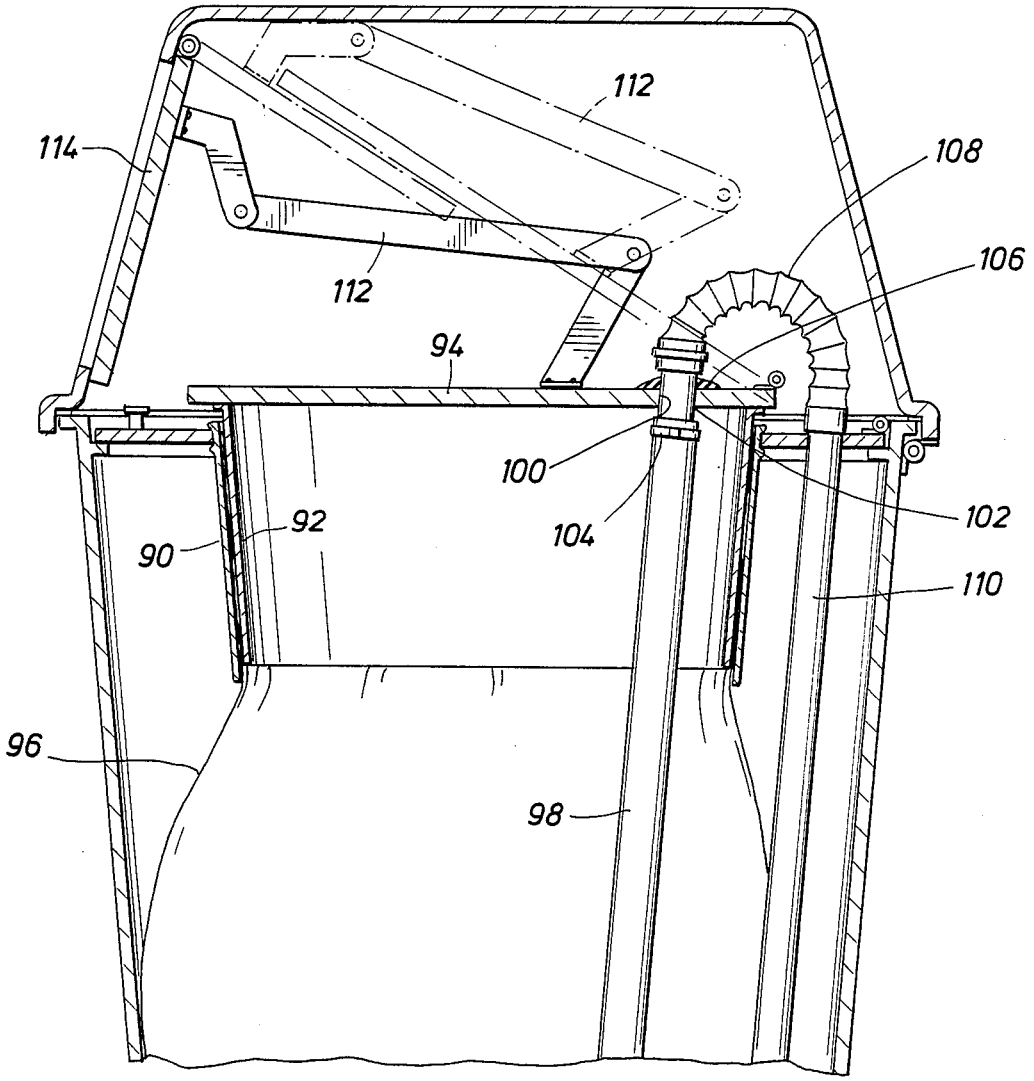
FIG. 7 is a cross sectional view similar to FIG. 1 of an alternate embodiment of this invention.

In the alternate embodiment of the invention shown in FIG. 7, annular members 90 and 92 are designed for the inner annular member 92 to extend upwardly beyond outer annular member 90 to engage lid 94 rather than as shown in the embodiment described above where the outer annular member engages lid 50. With this arrangement, the downward force of the differential pressure acting on lid 94, when a vacuum exists inside flexible bag 96, will tend to increase the clamping force between the two nesting tapered annular members 90 and 92 and improve the ability of the members to maintain a seal between the members and flexible bag 96.

This design change requires a change in the location of the opening through which flexible hose 98 extends into the bag. This could be done in either of two ways. In the embodiment shown, flexible hose 98 is attached to short pipe nipple 100 that extends through opening 102 in lid 94. Hose 98 is attached to the end of nopple 100 by hose clamp 104. Air is prevented from passing between nipple 100 and opening 102 by disc 106 of elastomeric material that is attached to nipple 100 and positioned to be pulled into sealing engagement with upper side of lid 94 when the pressure inside bag 96 is reduced. Hose 98 and nipple 100 are connected to the vacuum pump (not shown) by collapsable hose 108 and conduit 110. Collapsable hose 108 allows lid 94 to be raised to the dotted line position shown in FIG. 7 with very little extra force being imposed on finger 112.

An alternate way to connect the hose from the vacuum pump into the bag would be to extend inner annular member 92 upwardly far enough to allow connection to be made through the side wall of the annular member in the same manner as the hose was connected through the outer annular member in the embodiment shown in FIG. 1.

A different mechanism is used in this embodiment to lift lid 94 as door 114 is pushed inwardly. It consists of linkage 112 consisting of one link to cause the link fixed to the lid, and a connecting link to cause the lid to pivot upwardly as the door is moved inwardly to allow refuse to be placed in the bag. When the door is reduced, the weight of the lid will cause it to fall back into engagement with the inner annular member and at the same time closing the door.

Other than the above described changes, the embodiment of FIG. 7 is substantially the same as that described above and shown in FIGS. 1–6.

From the foregoing, it will be seen that this invention is one well adapted to attain all of the ends and objects hereinabove set forth, together with other advantages that are obvious and that are inherent to the apparatus and stucture.

It will be understood that certain features and subcombinations are of utility and may be employed without reference to other features and subcombinations. This is contemplated by and is within the scope of the claims.

Because many possible embodiments may be made of this invention without departing from the scope thereof, it is to be understood that all matter herein set forth or shown in the accompanying drawings is to be interpreted as illustrative and not in a limiting sense.

What is claimed is:

1. A refuse compactor comprising a flexible bag of non-permeable material having an opening through which refuse can be placed in the bag, two annular frusto-conical telescoping members having mating tapered sides between which the bag is clamped adjacent the opening for holding the bag open to receive refuse and for sealing the perimeter of the bag between the frusto-conical members, means for closing and sealing the opening in the bag, means to reduce the pressure in the bag below atmospheric pressure peridically to crush and compact the refuse in the bag, and means for urging further telescoping of the annular frusto-conical members when the pressure in the bag is below atmospheric to help maintain the seal between the annular members and the bag.

2. The compactor of claim 1, further comprising means for urging further telescoping of the annular frusto-conical members when the pressure in the bag is below atmopheric to help maintain the seal between the annular members and the bag.

3. A refuse compactor comprising a flexible bag of non-permeable material having an opening through which refuse can be placed in a bag, means for holding the bag open to receive refuse, means for closing and sealing the opening in the bag, a hose extending into the bag through which air is drawn from the bag, a vacuum pump connected to the hose for pumping air out of the bag to reduce the pressure in the bag below atmospheric pressure periodically to crush and compact the refuse in the bag, and an air and liquid separator located between the vacuum pump and the hose to separate the liquid removed from the bag from the air pumped out of the bag by the vacuum pump.

4. The compactor of claim 3 in which the air and liquid separator includes a housing having an upper chamber with an inlet through which the air and liquid from the bag enters the chamber and an outlet through which air flows from the chamber to the vacuum pump, said inlet and outlet being positioned for the air to flow substantially horizontally from the inlet to the outlet so the liquid will fall out of the air stream to the bottom of the chamber before the air moves through the outlet.

5. The compactor of claim 4 in which the separator includes a lower chamber located below the upper chamber and separated therefrom by a partition, an inlet to the lower chamber through which air pumped by the vacuum pump is discharged into the lower chamber and an outlet through which air and liquid in the lower chamber may flow, a passageway connecting the two chambers, and valve means to close the passageway when the air pressure in the lower chamber exceeds the air pressure in the upper chamber and to open the passageway when the air pressure in the two chambers is equal and the weight of the liquid in the upper chamber is sufficient to open the valve.

6. A method of compacting refuse comprising the steps of supporting a flexible wall, non-permeable, garbage bag in the vertical position with the opening in the bag facing upwardly, placing refuse in the bag through the opening, peridically closing the opening and reducing the pressure in the bag to cause the pressure difference between that in the bag and ambient atmospheric pressure to collapse the walls of the bag onto the refuse and compact it, positioning a flexible hose having openings therein to extend through the opening in the bag until the lower end of the hose is adjacent the bottom of the bag, removing the air and liquid in the bag through the hose to reduce the pressure in the bag and dewater the refuse therein, and separating the air from the liquid after removal from the bag.

7. A refuse compactor comprising a flexible bag of non-permeable material having an opening through which refuse can be placed in the bag, two annular frusto-conical telescoping members having mating tapered sides between which the side of the bag adjacent the open end is clamped for supporting the bag in the position to receive refuse through the opening and for sealing the perimeter of the bag between the frusto-conical members, one of the annular members extends upwardly above the other, means for sealing the opening in the bag including a lid extending across and in sealing engagement with the upwardly extending annular member, and means for reducing the air pressure in the bag below ambient atmospheric pressure to collapse the flexible bag onto the refuse and compact it.

8. The compactor of claim 7 further provided with a cover having a door mounted to pivot inwardly to provide an opening through which refuse can be placed in the bag.

9. A refuse compactor comprising a flexiable bag of non-permeable material having an opening through which refuse can be placed in the bag, two annular members having mating tapered sides between which the sides of the bag adjacent the open end is clamped for supporting the bag in a position to receive refuse through the opening, one of the annular members extending upwardly above the other, a lid extending across in sealing engagement with the upwardly extending annular member for sealing the opening in the bag, means for reducing the air pressure in the bag below ambient atmospheric pressure to collapse the flexible bag onto the refuse and compact it, and a cover having a door mounted to pivot inwardly to provide an opening through which refuse can be placed in the bag, whereby the inward movement of the door raises the lid away from the upwardly extending annular member to allow the refuse to be placed in the bag.

10. The compactor of claim 9 in which the lid is mounted to pivot into and out of engagement with the annular member and means are carried by the door to engage the lid and pivot it upwardly out of engagement with the annular member as the door is pivoted inwardly.

11. A refuse compactor comprising a flexible bag of non-permeable material having an opening through which refuse can be placed in the bag, means for supporting the bag in the position to receive refuse through the opening, means for sealing the opening in the bag, a flexible hose extending into the bag through which air is drawn from the bag, a vacuum pump connected to the hose for pumping air out of the bag for reducing the air pressure in the bag below ambient atmospheric pressure to collapse the flexible bag onto the refuse and compact it, and an air and liquid separator located between the vacuum pump and the hose to separate the liquid removed from the bag from the air pumped out of the bag by the vacuum.

12. The compactor of claim 11 in which the air and liquid separator includes a housing having a compartment with an inlet through which the air and liquid from the bag enters the compartment and an outlet through which air flows from the compartment to the vacuum pump, said inlet and outlet being positioned for the air to flow substantially horizontally from the inlet to the outlet so the liquid will fall out of the air stream to the bottom of the compartment before the air moves through the outlet.

13. The compactor of claim 12 in which the separator includes a second compartment located below the first mentioned compartment and separated therefrom by a partition, an inlet to the second compartment through which air pumped by the vacuum pump is discharged into the second compartment and an outlet through which air and liquid in the second compartment may flow, a passageway connecting the two compartments, and valve means to close the passageway when the air pressure in the second compartment exceeds the air pressure in the upper first compartment and to open the passageway when the air pressure in the two compartments is equal and the weight of the liquid in the upper first compartment is sufficient to open the valve.

14. A refuse compactor comprising a flexible bag of non-permeable material having an opening through which refuse can be placed in the bag, two annular frusto-conical telescoping members having mating tapered sides between which the side of the bag adjacent the open end is clamped for supporting the bag in the position to receive refuse through the opening and for sealing the perimeter of the bag between the frusto-conical members, means for sealing the opening in the bag, means for reducing the air pressure in the bag below ambient atmospheric pressure to collapse the flexible bag onto the refuse and compact it, and means for urging further telescoping of the annular frusto-conical members when the pressure in the bag is below atmospheric to help maintain the seal between the annular members and the bag.

* * * * *